US006832065B2

(12) United States Patent
Nakamura et al.

(10) Patent No.: US 6,832,065 B2
(45) Date of Patent: Dec. 14, 2004

(54) ROLL AND DEVELOPMENT APPARATUS USING THE SAME

(75) Inventors: Makoto Nakamura, Tokyo (JP); Yoshiyuki Takano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/284,159

(22) Filed: Oct. 31, 2002

(65) Prior Publication Data

US 2003/0086730 A1 May 8, 2003

(30) Foreign Application Priority Data

Oct. 31, 2001 (JP) ..... 2001-333952

(51) Int. Cl.[7] ..... G03G 15/08
(52) U.S. Cl. ..... 399/286; 492/56
(58) Field of Search ..... 399/53, 55, 265, 399/267, 270, 276, 279, 282, 285, 286; 492/56, 8, 59; 430/120, 124, 126, 105

(56) References Cited

U.S. PATENT DOCUMENTS 5,991,585 A 11/1999 Nakamura ..... 399/267
6,070,038 A 5/2000 Imamura et al. ..... 399/277
6,112,042 A 8/2000 Imamura et al. ..... 399/277
6,287,246 B1 9/2001 Yoshii et al. ..... 492/56
6,347,208 B1 * 2/2002 Yamamoto ..... 399/281
6,473,588 B2 10/2002 Nakamura ..... 399/286
6,580,892 B2 * 6/2003 Ohuchi ..... 399/286

FOREIGN PATENT DOCUMENTS

JP 53-3233 1/1978
JP 2000-338772 A * 12/2000

* cited by examiner

*Primary Examiner*—Hoan Tran
(74) *Attorney, Agent, or Firm*—Oblon, Spivak, McClelland, Maier & Neustadt, P.C.

(57) ABSTRACT

A roll including a core shaft formed from metal, an elastic layer formed from resin or rubber material arranged around the core shaft and having a resistance, and a surface layer arranged around the elastic layer and having a resistance. The resistance of the surface layer is smaller than that of the elastic layer so that the entire volume resistance of the roll is less than a volume resistance of the elastic layer.

14 Claims, 7 Drawing Sheets

EMBODIMENT 1

EMBODIMENT 2

EMBODIMENT 3

EMBODIMENT 4

EMBODIMENT 5

COMPARATIVE EXAMPLE 1

COMPARATIVE EXAMPLE 2

COMPARATIVE EXAMPLE 3

COMPARATIVE EXAMPLE 4

ROLL AND DEVELOPMENT APPARATUS USING THE SAME

BACKGROUND OF THE INVENTION

1. Field of the Invention

The present invention relates to an improvement in a roll used, for example, as a development roll in an electrophotographic apparatus such as a copying machine, a printer, a facsimile, etc.

2. Description of the Prior Art

Recently, a simplification of maintenance has been promoted in a field of an electro-photographic device, such as copying machine, a printer, a facsimile and so on, especially, a small electro-photographic device. In practice, a development device (hereinafter referred to as prior art) is used to develop an electrostatic latent image formed on an image bearing body such as a surface of photosensitive body, a photosensitive paper, a recording paper, etc., by using single component toner as disclosed in Japanese Patent Publication No. Sho 53 (1978)-3233.

FIG. 14 shows a conventional typical development apparatus. The development apparatus comprises a photosensitive drum 101 which includes a surface layer portion A and a substrate portion B.

The surface layer portion A acts as an image bearing body and the substrate portion B acts as a supporting member for the image bearing body.

The substrate portion B comprises a conductive elastic rubber 103 adhered on a surface of a metallic drum 102 and a flexible metallic foil 104 such as aluminum foil adhered on the rubber. The surface layer portion A comprises a photoconductive insulating layer 105 in which a metal such as selenium is formed by evaporating it on the metallic foil.

A development roll 106 is provided into press-contact with a surface of the photosensitive body 101.

The development roll 106 has a metallic roll 107 and an elastic layer 108 composed of a compositive rubber and a urethane foam, etc, formed on a surface of the metallic roll.

Because a plasticizer and a low molecular substance which have been bred out from the elastic layer 108 of the development roll 106 contaminate the surface layer portion A of the photosensitive body 101 and adhesion (tacking) and filing of the toner occur on the elastic layer 108 of the development roll 106, there has been also developed a development roll for preventing breed out of the plasticizer and low molecular substance and the adhesion and filming of the toner by coating a surface layer (not shown) of resin having a good mold-releasing property of toner on the surface of the elastic layer 108 of the development roll 106.

A bias power source 109 is connected between the development roll 106 and the substrate portion B of the photosensitive drum 101.

A hopper 111 for containing single component nonmagnetic toner 110 is provided at an upper portion of the development roll 106 in such a manner that a lower opening of the hopper is arranged with a predetermined space from the surface of the development roll 106. A frictional charging member 112 is adhered to an inside of a right side wall of the hopper. A uniformized member 113 is provided in such a manner that a surface thereof is arranged in press-contact with the surface of the development roll 106.

The uniformized member 113 comprise a metallic roll 114, a rubber layer 115 adhered to a surface of the roll and a frictional charging member 116 coated on the rubber layer. The uniformized member is not rotated.

According to the development roll 106, a thin layer of toner is carried onto the surface of the development roll 106. The roll formed in such way is abutted with the photoconductive drum 101 to which electrostatic latent image is formed and then the toner is transferred from the development roll 106 to the photoconductive drum 101 in response to development electric field to visualize the electrostatic latent image recorded on the photoconductive drum 101.

In the aforementioned development roll, it is necessary to control polarity of charge and charging amount of the toner by fictional charge due to contact between the toner and the surface of the development roll 106.

The transfer of toner to the photoconductive drum 101 is performed in response to the development electric field and the polarity of toner charge by selecting an image portion of the electrostatic latent image or a non-image portion (naked portion) of the latent image. According to this apparatus, there is an advantageous effect that colorization is easy without using any magnetic material for the toner.

In the conventional development apparatus using single component of toner, some attempts are made to reduce hazards upon charging by lowering charging potential in order to lengthen life duration of the apparatus, especially the long life duration of the photosensitive body. Thus, there has been needed a system capable of developing with a reduced development potential.

From the viewpoint of higher image quality, it has been required to make as low as possible the saturated development potential and to sharpen the development $\gamma$ (gradation of a characteristic curve for image concentration level with respective to the electrostatic potential) to a possible extent. This enables to change from multi-values which provide a writing modulation pattern of image by using a great number of gradations, to binary values which provide the writing modulation pattern of image by using two gradations (i.e., perform change of gradation by operation of dots with the same concentration of dots), in order to change a gradient expression of image in digital to an area gradation.

Reducing resistance of the development roll to sharpen the developments $\gamma$ is a well-known. However, if the resistance of the development roll is reduced, a higher voltage, e.g., −250 V as the bias voltage is applied. Accordingly, there is a problem that a leak of electricity to the electrostatic latent image bearing body occurs. For this reason, in prior art, the leak of electricity to the electrostatic latent image bearing body has been prevented by adding conductivity-imparting agent such as carbon black to the elastic layer 108 of the development roll 106 thereby to make the resistance of the elastic layer 108 lower than that of the surface layer of the development roll 106.

However, if the conductivity-imparting agent such as carbon black is highly charged in the elastic layer 108, since the elastic layer is hardened, there are problems that (1) a sufficient nip cannot be obtained between the development roll 106 and the photoconductor drum 101, thus resulting in a deterioration of image quality and (2) manufacturing facility is impaired, thus resulting in a difficulty in forming the elastic layer 108 into a shape of roll.

SUMMARY OF THE INVENTION

It is an object of the present invention to provide a roll for resolving the aforementioned problems in prior art. More specifically, it is an object of the present invention to provide a roll capable of carrying out reductions in hardness and resistance without any fear of leak to the latent image, and provide a development apparatus for using the roll.

To accomplish the above object, according to an aspect of the present invention, a roll is provided in which it comprises a core shaft, an elastic layer arranged around said core shaft and having a resistance, and a surface layer arranged around said elastic layer and having a resistance. The resistance of the surface layer is smaller than that of the elastic layer so that the entire volume resistance of the roll is less than a volume resistance of the elastic layer.

In one embodiment, the volume resistance of the elastic layer is less than $1.0\times10^9$ Ω·cm. The entire volume resistance of the roll is also less than $1.0\times10^7$ Ω·cm.

Further, an actual resistance of said surface layer is less than $1.0\times10^8$ Ω, and a thickness of said surface layer is less than 30 μm.

According to the other aspect of the present invention, a development apparatus is provided, in which it comprises the roll as described above.

In one embodiment, the development apparatus has a photosensitive body having an image portion and a quantity of toner adhering onto said photosensitive body is saturated under a condition that a difference between a development bias and a surface potential of said image portion in said photosensitive body is less than 150 V.

BRIEF DESCRIPTION OF THE DRAWINGS

Further objects and advantages of the present invention will be apparent from the following description of the preferred embodiments of the invention with reference to the accompanying drawings, in which.

DETAILED DESCRIPTION OF THE PREFERRED EMBODIMENTS

Embodiments in case that a roll according to the present invention is applied to a development roll in a development apparatus will be explained below.

Figure 1:
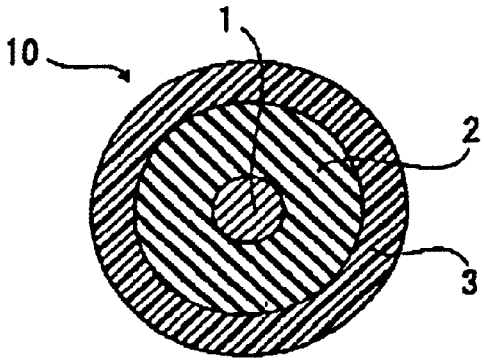
FIG. 1 is a section view of a development roil according to an aspect of the invention.

In FIG. 1, the development roll at 10 comprises a core shaft 1 formed from metal, an elastic layer 2 formed about the core shaft 1, which is composed of rubber, resin or elastomer and a surface layer 3 formed about the elastic layer 2.

The resin or rubber material for forming the elastic layer 2 may be any one or a mixture of, for example, polyurethane, ethylene-propylene-diene polymerization (EPDM), natural rubber, butyl rubber, nitrile rubber, acrylonitrile-butadiene rubber (NBR), epichlorohydrrin rubber, polyisoprene rubber, polybutadiene rubber, silicone rubber, styrene-butadiene rubber, ethylene-propylene rubber, chloroprene rubber, and acrylic rubber.

The above-mentioned resin and rubber materials are intended only for examples. Accordingly, any other suitable resin or rubber material may be used as long as they accord with the object of the present invention.

In order to provide the rubber elasticity through cross-linking, compounding agents such as cross-linking agent and vulcanized agent may be added to the above resin or rubber material. In each case of performing organic peroxide cross-linking and sulfur cross-linking using the aforementioned compounding agents, compounding agents such, as vulcanized auxiliary agent, vulcanized accelerator, vulcanization retardant and so on may be also used.

Additionally, to the resin or rubber material, there may be added as the other compounding agents than the above-mentioned compounding agents, for example, foaming agent, plasticizer, softener, tackifier, anti-tack agent, separating agent, mold release agent, extender, and coloring agent and so on which are usually used within a scope of maintaining the characteristics of the elastic layer 2.

Although the hardness of the elastic layer 2 is not particularly limited, it has a JIS-A hardness not higher than 60 degrees, and preferably has a JIS-A hardness ranging from 25 to 50 degrees, in a case that the development roll 10 contacts with the photosensitive body. If the elastic layer 2 is too hard, and if the photosensitive body is a drum, then this makes nip width narrow, which may be disable a good development.

Conversely, a hardness of the elastic layer being too lower results in a larger permanent compress strain and if a deformation and offset are occurred in the development roll, then uneven print concentration on.

Since a low-hardness surface greatly depends on the specific physical properties of the material, usable materials are limited. If the hardness of the elastic layer 2 is also set lower, it is preferable to reduce the permanent compress stain, preferably to be smaller then 20%.

A resin material that may be used for the surface layer 3 is not especially limited as long as they have non-contaminative property for the toner or the electrostatic latent image bearing body. In order to be coated on the surface of the elastic layer 2, material used in the surface layer preferably has at least flexibility and wear resistance. For resin material constituting the surface layer, there may be used, for example, a copolymer of urethane resin, polyester resin, silicone resin, fluoro resin and fluoro olefin, and ethylene unsaturated monomers such as a variety of vinyl ethers, a variety of allyl ethers and a variety of vinyl esters.

The above-mentioned resin materials are intended only for examples. Accordingly, any other suitable resin materials may be used as long as they accord with the object of the invention. To these resin materials, there may be added the same additives as used in the resin materials for the elastic layer 2. Also, a hardener may be used in order to improve wear resistance and toner tolerance of the surface layer 3.

The surface layer 3 preferably has a thickness equal to or less than 30 $\mu$m. If the thickness of the surface layer 3 exceeds 30 $\mu$m, then the surface layer 3 becomes higher in the hardness than the elastic layer 2, there are problems that the surface layer 3 becomes easy to break the creep characteristic deteriorates and more time is required for recovery from a depression and so on.

Thus, according to the present invention, setting the thickness of the surface layer 3 equal to or less than 30 $\mu$m prevents the paper from being rumpled without affecting the hardness of the elastic layer 2 or without being affected by a coefficient of contraction. The surface layer 3 is formed on the elastic layer 2 by using any of well-known coating technique such as dipping, roll coating, knife coating, spraying, etc.

An important feature of the development roll 10 according to the invention resides in an electric characteristic. That is, according to an aspect of the invention, an arrangement is so made as to make the volume resistance of the entire development roll 10 smaller than that of the elastic layer 2 by setting the resistance of the surface layer 3 smaller than that of the elastic layer 2. The "volume resistance" has a unit "Ω·cm" and is defined as a current that flows when a voltage of 1 V is applied between the core shaft 1 and a plate electrode on which the development roll 10 is placed with a predetermined pressure applied to both ends of the core shaft 1.

Since the volume resistance of the entire development roll 10 is made smaller than that of the elastic layer 2 by setting the resistance of the surface layer 3 smaller, than that of the elastic layer 2, there is no need of adding, to the elastic layer 2, as much a conductivity-imparting agent as has been added to lower the resistance of the elastic layer in conventional development rolls. This enables reductions in the hardness and the resistance of the development roll 10, permitting a wide selection of elastic layer 2 materials, while there is no possibility of leak of a current to the electrostatic latent image.

In order to control the resistances of elastic layer 2 and surface layer 3, various conductivity-imparting agents are added to the resin or rubber material constituting these layers. If more amount of conductivity-imparting agent are added, the smaller the resistances of elastic layer 2 and surface layer 3 becomes.

Examples of the conductivity-parting agent include, as powders, (1) conductive blacks such as Ketjen black EC and acetylene black; (2) carbons for rubber such as SAF (Super Abrasion Furnace), ISAF (Intermediate SAF), HAF (High Abrasion Furnace), FEF (Fast Extruding Furnace), GPF (General Purpose Furnace), SAF (Semi-Reinforcing Face), FT (Fine Furnace), and MT (Medium Thermal); (3) carbons for color to which a treatment such as oxidization has been applied; (4) pyrolytic carbon; (5) metal single bodies such as copper powder, silver powder, germanium power and aluminum powder; (6) metal oxides such as ZnO, $SnO_2$, $TiO_2$, and indium-doped $SnO_2$; and (7) conductive polymers such as polyaniline, polypyrrole, and polyacetylene.

Also, as the conductivity-imparting agent, there may be used ionic conducting materials: for example, (1) inorganic ionic conducting materials such as sodium perchlorate, calcium perchlorate, lithium perchlorate, and lithium chloride; and (2) organic ionic conducting materials such as denatured fatty acid, dimethylammonium ethosulfate, ammonium stearate acetate, lauryl ammonium acetate, and octadecyltrimethylammonium perchlorate.

Further, according to the present invention, the resistance of the elastic layer 2 is preferably equal to or lower than $1.0\times10^9$ Ω·cm and, more preferably, ranges from $10^8$ to $10^9$ Ω·cm. A resistance under $10^8$ Ω·cm will result in a remarkable loss of working easiness of the material and cause a rise of the hardness, while a resistance over $10^9$ Ω·cm will make it difficult to give a preferable resistance value (less than $1.0\times10^7$ Ω·cm) to the entire development roll which has had the surface layer 3 coated.

Since the resistance of the entire development roll 10 is equal to or lower than $1.0\times10^7$ Ω·cm, the amount of toner adhering onto the photosensitive body (denoted by a numeral "15" in FIG. 4) may be saturated with a development potential under 150 V, which is much lower than development potentials of the conventional development apparatus. Also, lowering the volume resistance of the entire development roll 10 enables the development bias (i.e., the electrostatic potential of the photosensitive body) to be set to a lower value, e.g., 300 V. In this case, a portion of the electrostatic latent image is several tens in voltage. Accordingly, if the naked potential of the remaining portion other than the portion of the latent image is assumed to be 100 V, then the development bias is lower than 200 V.

An actual resistance of the surface layer 3 is preferably equal to or less than $1.0\times10^8$Ω. This enables the adhering toner quantity on the photosensitive body to be saturated with a development potential under 150 V, which is much lower than development potentials of the conventional development apparatus.

According to the development apparatus of the present invention, the adhering toner quantity on the photosensitive body comes to a saturation in a state in which the difference between the bias voltage and the surface potential of a portion of the latent image on the photosensitive body is equal to or less than 150 V. Accordingly, (1) though the development roll has a lower resistance, leak to the photosensitive body does not occur; (2) low-potential binary value development is achieved; and (3) since the electrostatic potential of the photosensitive body can be lowered, the lifetime of the photosensitive body can be lengthened.

Figure 2:
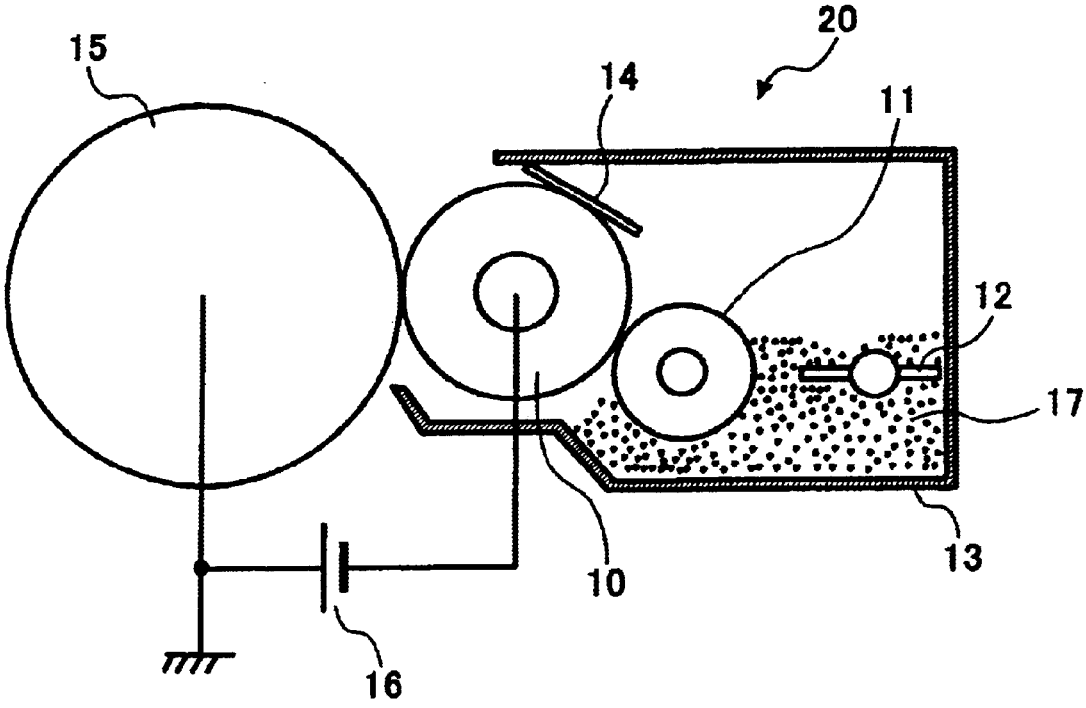
FIG. 2 is a schematic explanatory view showing a development apparatus having the development roll of FIG. 1 in accordance with another aspect of the invention.

As shown in FIG. 2, a development apparatus 20 in one embodiment of the present invention comprises the development roll 10, a feeder roll 11 having a core shaft and a sponge layer formed about the core shaft, a toner agitating member 12 and a case 13 having a side plate on which the development roll, feed roll 11 and toner agitating member 12 are pivoted. Toner 17 is supplied to the surface of the development roll 10 through the feeder roll 11 by means of the toner-agitating member 12.

The toner 17 supplied on the development roll 10 is formed into a thin layer of a predetermined quantity by a toner layer-forming member 14 and is transferred to a photosensitive body 15 by the rotating development roll 10, which is into contact with the photosensitive body 15. The development apparatus 20 further includes a bias power supply 16 for supplying a bias voltage between the development roll 10 and the photosensitive body 15.

The bias voltage is in the middle of the electrostatic potential of photosensitive body 15 and the residual potential after an optical recording or an exposure. The toner 17 on the development roll 10 is advanced to a region in contact with the photosensitive body 15, where the toner 17 is moved onto the photosensitive body 15 in response to the photosensitive body 15 potential and the development electric field by the bias voltage to visualize the electrostatic latent image.

The toner 17 used in this embodiment is resin particles obtained by blending charging control agent (CCA) and color agent with polyester, polyol, styrene resin, acrylic resin, etc. In order to enhance the fluidity, additive including silica, titanium oxide, etc. is added around the above-mentioned resin particles.

The additive typically has a particle diameter ranging from 0.1 to 1.5 $\mu$m. Examples of color agents are carbon black, phthalocyanine blue, quinacridone, and acetocarmine. The charging polarity is negative. As the toner 17, there may be used a toner material in which any of the above additives are added to a primary or mother toner into which wax or the like is dispersedly mixed.

The average particle diameter of the toner 17 is preferably in a range from 3 to 12 $\mu$m. In this embodiment, the particle of the toner is 7 $\mu$m in the average diameter, and can be practically applied to images of more than 1200 dpi in the resolution.

For the toner layer forming member 14, there may be used (1) metals such as stainless steels, phosphor bronze, etc. or (2) elastic materials such as urethane rubber, silicone resin, etc. The toner layer-forming member 14 may be adapted to coat various materials on a portion of contacting with the development roll 10.

In order to clarify the effect of the present invention, five examples of the roll and development apparatus according to the present invention and four comparative examples with the conventional development apparatus will be described below. Then, the results of measurement made for the five example and four comparative examples will be presented.

EXAMPLE 1

First, an adhesive was previously applied on a circumferential surface of a core shaft 1 of 8 mm in diameter of stainless steel (SUS); an urethane elastomer layer was formed by coating, through the one-shot process, on the adhered circumferential surface of the core shaft with a resin re comprised of polyol and isocyanate which mixture had 5 wt % of carbon black dispersed therein; and the outer surface of the urethane elastomer layer was ground into a diameter of 16 mm thereby to form a roll having a 4 mm-thick elastic layer 2 around the SUS core shaft 1. A fluoro resin (Sumitomo 3M Co., Ltd., THV220P) was dissolved into a methyl ethyl ketone (MEK) to make a fluoro resin solution; 20 wt % of carbon black (with respect to the fluororesin) was dispersed into the fluoro resin solution to make a fluoro resin embrocation (or application liquid); and the fluoro-resin embrocation was sprayed on the elastic layer to form a surface layer 3 of 20 $\mu$m in thickness. In this way, the development roll 1 has completed,

EXAMPLE 2

A roll having an elastic layer on the surface of an SUS core shaft was formed in the same manner as in cane of the example 1; and a conductive urethane paint (Nippon Miractran Co., Ltd., SUPEREX) with which MEK was used as the solvent was sprayed on the elastic layer 2 to form the surface layer 3 of 20 $\mu$m in thickness, yielding the development roll 1.

EXAMPLE 3

To an epichlorohydrin rubber, there were added a calcium carbonate, a sulfur and a vulcanization accelerators to form an epichlorohydrin rubber mixture; an adhesive was applied on the circumferential surface of a stainless steel (SUS) core shaft 1 of 8 mm in diameter, an epichlorohydrin rubber layer was formed by extruding the epichlorohydrin rubber mixture around the circumferential surface; and the outer surface of the urethane elastomer layer was ground into a diameter to 16 mm thereby to form a roll having a 4 mm-thick elastic layer 2 around the SUS core shaft. Then, the fluoro resin embrocation prepared in the same way as in case of the example 1 was sprayed on the elastic layer to form a surface layer 3 of 20 $\mu$m in thickness, yielding the development roll 1.

EXAMPLE 4

A roll having an elastic layer on the surface of an SUS core shaft was formed in the same manner as in case of the example 1; a fluoro resin (Asahi Glass Co., Ltd., lumiflon) which is a copolymer of a fluoro olefin and a ethylene unsaturated monomers was resolved into a mixed liquid of a toluene and a xylene to make a fluororesin solution; 66 wt % (with respective to the fluoro resin) of metal oxide (ITO) and 20 wt % of hardener were dissipated into the fluoro resin solution to yield a fluoro resin embrocation; the fluoro resin embrocation was sprayed on the elastic layer 2 and heated for hardening to form a surface layer 3 of 20 $\mu$m in thickness, yielding the development roll 1.

EXAMPLE 5

A roll having an elastic layer 2 on the surface of an SUS core shaft was Conned in the same manner as in case of the example 3; and the surface layer 3 was formed on the elastic layer 2 in the same manner as in case of the example 4.

COMPARATIVE EXAMPLE 1

A roll having an elastic layer on the surface of an SUS core shaft was formed in the same-manner as in case of the example 1; a fluoro resin (Sumitomo 3M Co., Ltd., THV220P) was dissolved into a methyl ethyl ketone (MEK) to make a fluoro resin solution; 3 wt % of carbon black (with respect to the fluoro resin) was dispersed into the fluoro resin solution to make a fluoro resin embrocation (or application liquid); and the fluoro resin embrocation was sprayed on the elastic layer to form a surface layer of 20 $\mu$m in thickness, yielding a development roll.

COMPARATIVE EXAMPLE 2

A roll having an elastic layer on the surface of an SUS core shaft was formed in the same manner as in case of the example 3; and a surface layer was formed on the elastic layer in the same manner as in case of the comparative example 1.

COMPARATIVE EXAMPLE 3

A roll having an elastic layer on a surface of an SUS-core shaft was formed in the same manner as in case of the example 1; a fluoro resin (Asahi Glass Co., Ltd., lumiflon) which is a copolymer of a fluoro olefin and a ethylene unsaturated monomers was resolved into a mixed liquid of a toluene and a xylene to make a fluoro resin solution; 58 wt % (with respective to the fluoro resin) of metal oxide (ITO) and 20 wt % of hardener were dissipated into the fluoro resin solution to yield a fluoro resin embrocation; the fluoro resin embrocation was sprayed on the elastic layer and heated for hardening to form a surface layer of 20 $\mu$m in thickness, yielding a development roll 1.

COMPARATIVE EXAMPLE 4

An adhesive was applied on a circumferential surface of a stainless steel (SUS)-core shaft having 8 mm in diameter; an urethane elastomer layer was formed by coating, through the one-shot process, on the adhered circumferential surface with a resin mixture comprised of polyol and isocyanate which mixture had 2 wt % of carbon black dispersed therein; and the outer surface of the urethane elastomer layer was ground into a diameter of 16 mm thereby to form a roll having a 4 mm-thick elastic layer around the SUS core shaft. Then, a surface layer was formed on the elastic layer in the same manner as in case of the comparative example 3.

For each of the above-described examples 1 through 5 and comparative examples 1 through 4, we obtained various data through measurements.

The measured data include the development potential (V) and the photosensitive body-adhering toner quantity (mg/cm$^2$) under the development potential. The relationship between development potential and photosensitive body-adhering toner quantity is shown in graphs of respective FIGS. 5 through 9 for the examples 1 through 5 and in graphs of respective FIGS. 10 through 13 for the comparative examples 1 through 4.

Also, the measured data include the hardness (degrees) according to the JIS-A standard; the elastic layer resistance (Ω·cm); the surface layer resistance (Ω); and the volume resistance (Ω·cm), which means resistance due to the elastic layer and the surface layer. These data for each of the examples 1–5 and the comparative examples 1–4 are listed in the following table.

In the above table, "Resistance Comparison" is a comparison between the elastic layer resistance (E) and the surface layer resistance (S). A notation "E>S" indicates that the elastic layer resistance is larger than the surface layer resistance, and vice versa.

The "saturating development potential" is the development potential for which the amount of toner adhering to the surface of the photosensitive body comes to be saturated. The values of saturating development potentials were found from the graphs of FIGS. 5 through 13.

Figure 3:
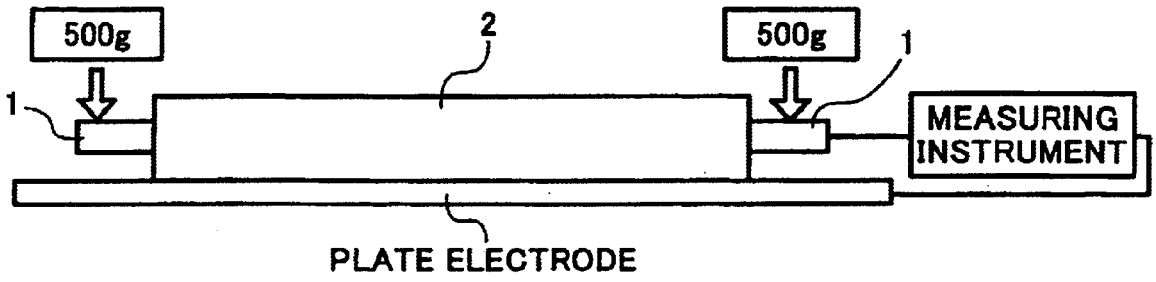
FIG. 3 is an explanatory view for explaining a measuring method for a volume resistance of the development roll.

The volume resistance of the entirety of each development toll was measured by using a resistance meter RS340A commercially available from Advantest Corporation (Japan) as shown in FIG. 3.

The volume resistance for each development roll was measured by putting the development roll on a plate electrode with a predetermined pressure (500 g in this specific example) applied to each end of the core shaft 1 of the development roll, while applying a voltage of 1 V between the core shaft 1 and the plate electrode for 30 seconds.

Figure 4:
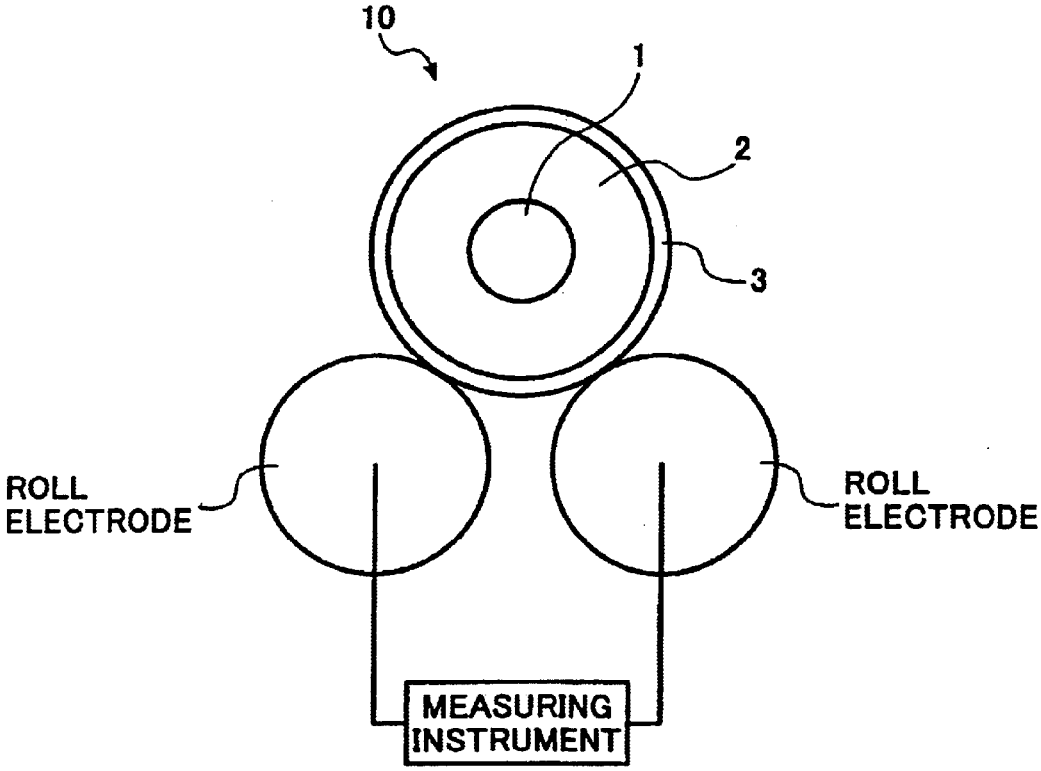
FIG. 4 is an explanatory view for explaining a measuring method for a resistance of the surface layer of the development roll.
Figure 5:
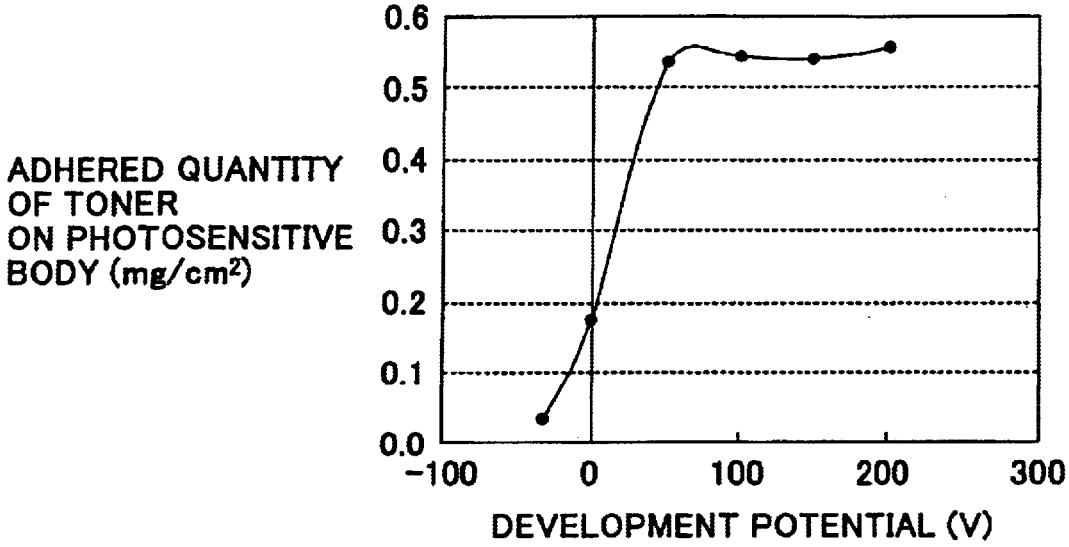
FIG. 5 is a graph showing a relationship between the development potential of the development roll and the amount of toner adhering onto the photosensitive body in an embodiment 1.
Figure 6:
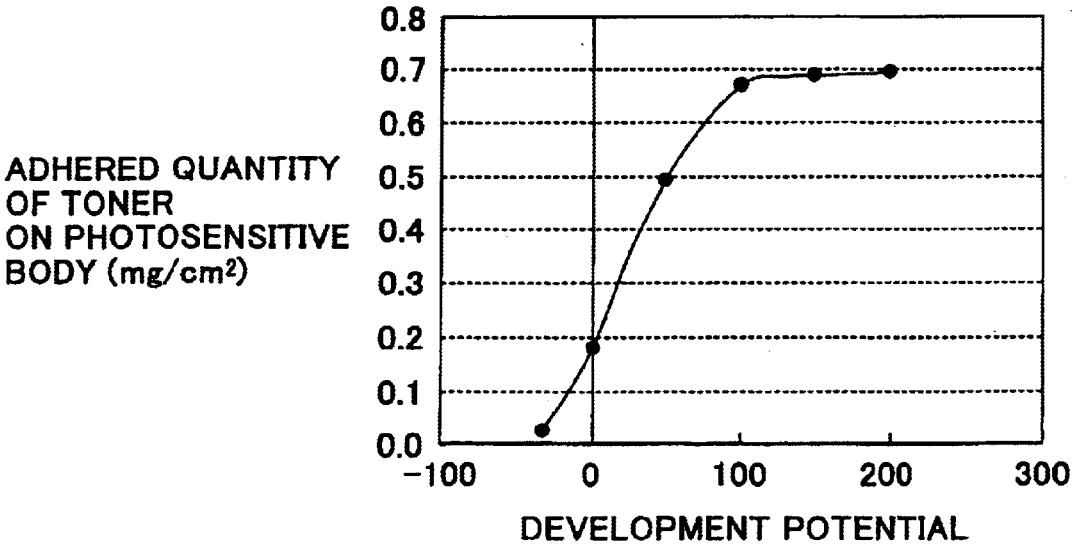
FIG. 6 is a graph showing is a graph showing a relationship between the development potential of the development roll and the amount of toner adhering onto the photosensitive body in an embodiment 2.
Figure 7:
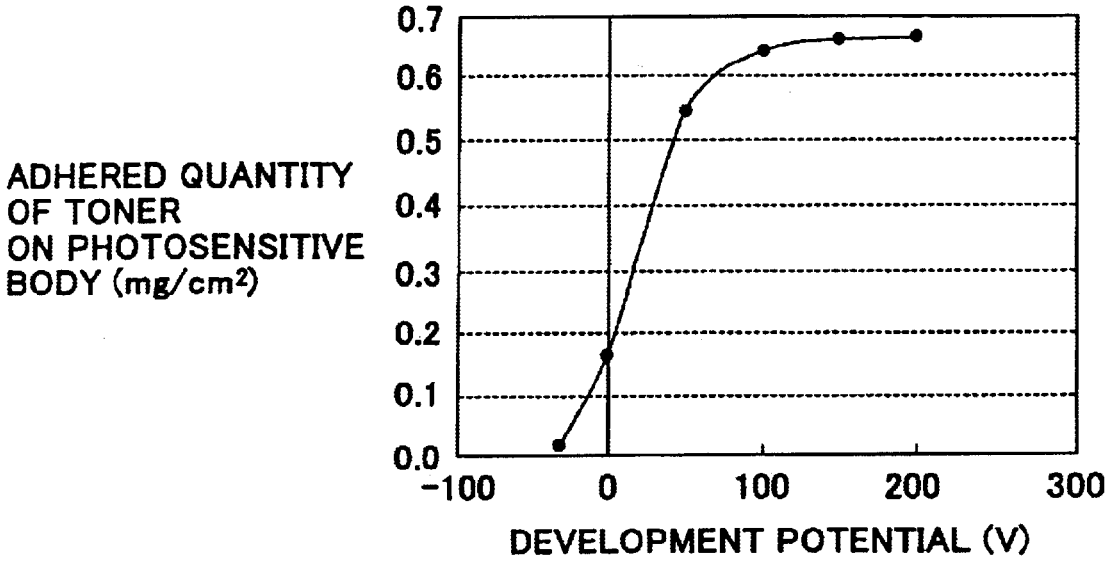
FIG. 7 is a graph showing is a graph showing a relationship between the development potential of the development roll and the amount of toner adhering onto the photosensitive body in an embodiment 3.
Figure 8:
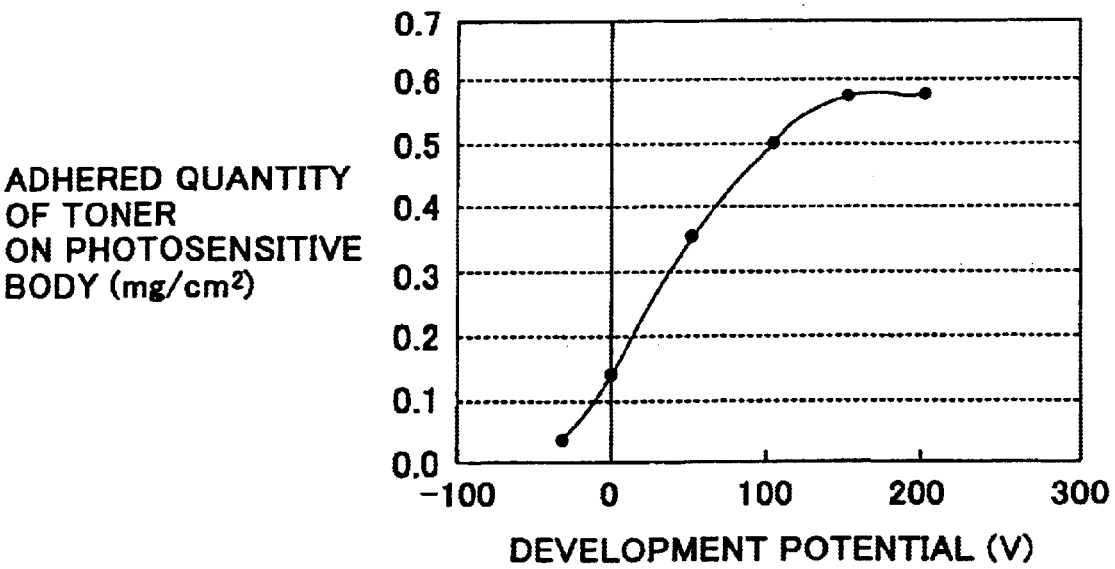
FIG. 8 is a graph showing is a graph showing a relationship between the development potential of the development roll and the amount of toner adhering onto the photosensitive body in an embodiment 4.
Figure 9:
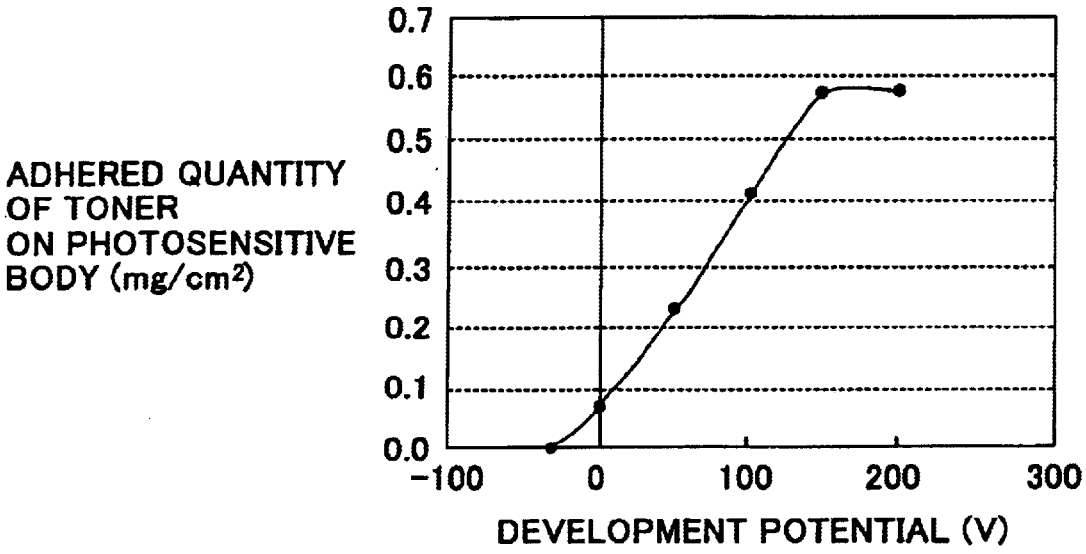
FIG. 9 is a graph showing is a graph showing a relationship between the development potential of the development roll and the amount of toner adhering onto the photosensitive body in an embodiment 5.
Figure 10:
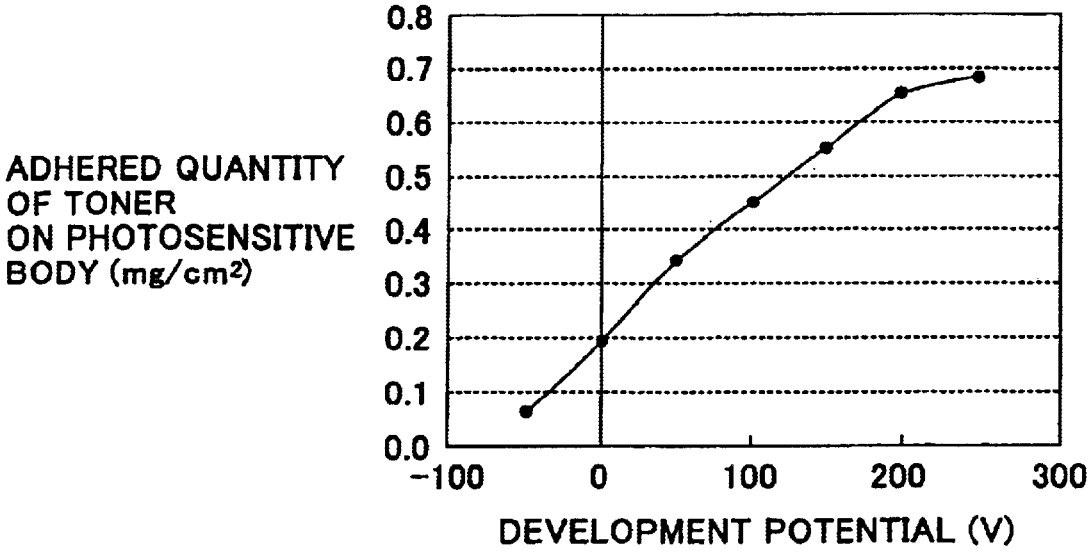
FIG. 10 is a graph showing is a graph showing a relationship between the development potential of the development roll and the amount of toner adhering onto the photosensitive body in a first comparative example.
Figure 11:
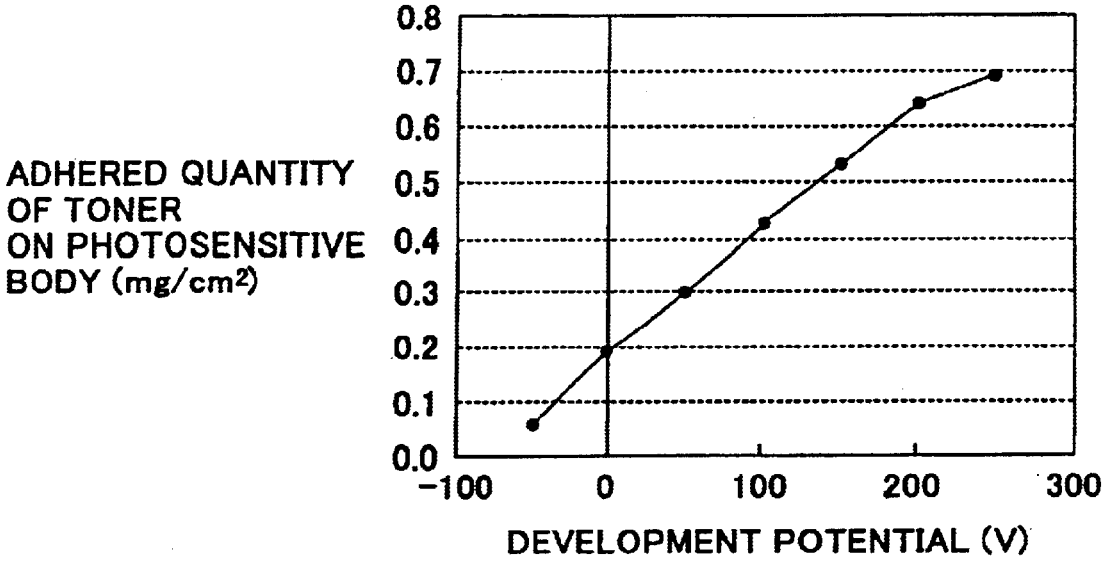
FIG. 11 is a graph showing is a graph showing a relationship between the development potential of the development roll and the amount of toner adhering onto the photosensitive body in a second comparative example.
Figure 12:
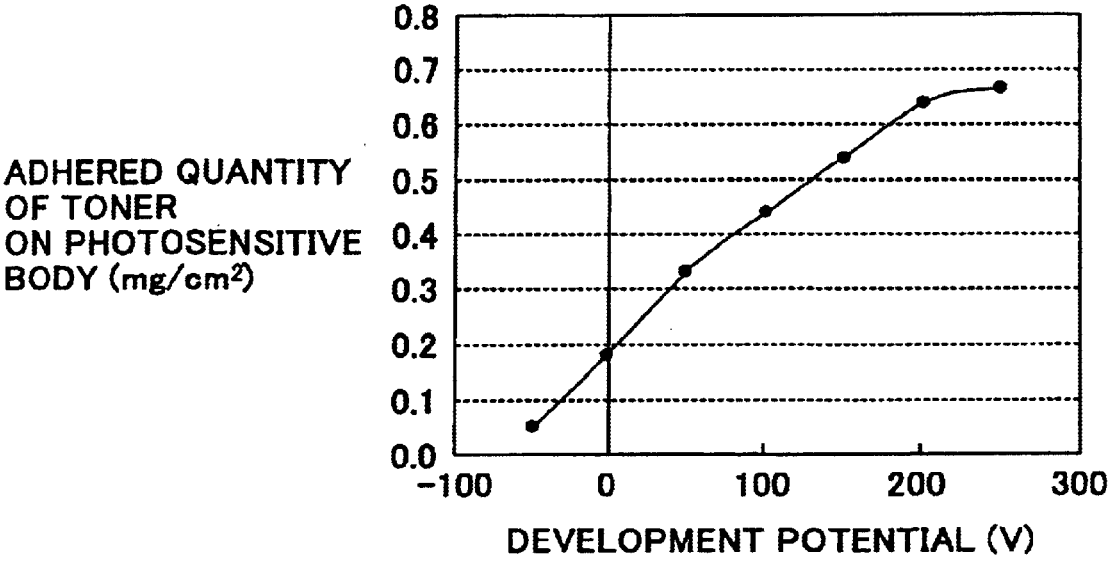
FIG. 12 is a graph showing is a graph showing a relationship between the development potential of the development roll and the amount of toner adhering onto the photosensitive body in a third comparative example.
Figure 13:
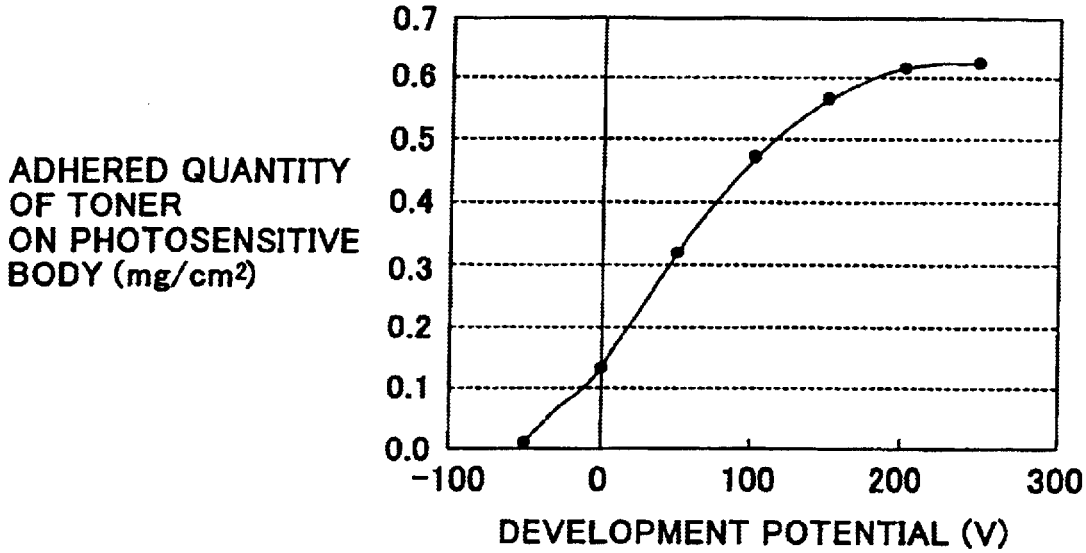
FIG. 13 is a graph showing a relationship between the development potential of the development roll and the amount of toner adhering onto the photosensitive body in a fourth comparative example.
Figure 14:
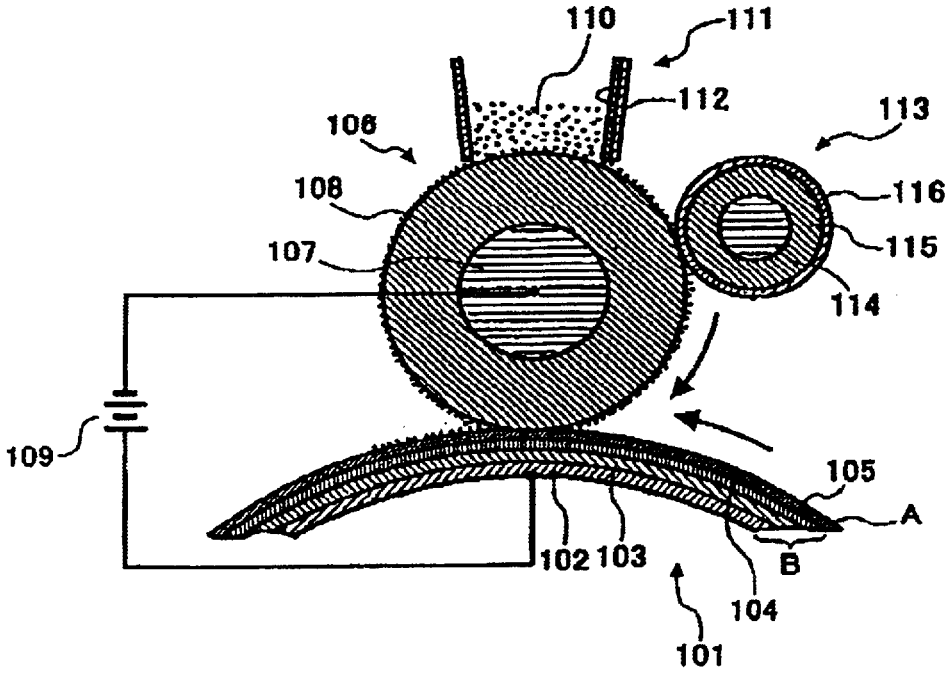
FIG. 14 BACKGROUND ART
FIG. 14 is diagram showing an overview of a conventional development apparatus.

The surface layer (S layer) resistance of each development roll was also measured by using the above-mentioned resistance meter as shown in FIG. 4.

The measurement was made by setting the surface layer of the development roll in pressure contact with two roll electrodes fixed in parallel with each other and applying a voltage of 1 V between the two roll electrode for 30 seconds.

According to the present invention, the entire volume resistance of the development roll is made smaller (preferably, $1\times10^7$Ω·cm or less) than that of the elastic layer by setting the resistance of the surface layer (preferably, $1\times10^8$Ω or less) smaller than that of the elastic layer (preferably, $10^8$~$10^9$Ω).

This eliminates the need of adding, to the elastic layer, as much a conductivity-imparting agent as has been added to lower the resistance of the elastic layer in conventional development roll. This enables reductions in the hardness and the resistance of development roll, permitting a wide selection of elastic layer materials, while there is no possibility of leak to the electrostatic latent image.

Setting the volume resistance of the entire development roll equal to or lower than $1.0\times10^7$ Ω·cm makes it possible to saturate the photosensitive body-adhering toner amount with a development potential under 150 V.

Also, lowering the volume resistance enables the development bias to be set to a lower value, e.g., 300 V. In this case, a portion of the electrostatic latent image is several tens in voltage.

Accordingly, if the potential of the remaining portion other than the portion of the latent image is assumed to be 100 V, then the development bias is lower than 200 V.

TABLE

| | resistance comparison | J IS-A Hardness (degree) | E. layer Resistance (Ω · cm) | S. layer Resistance (Ω) | Volumn Resistance (Ω · cm) | Saturating Development Potential(V) |
|---|---|---|---|---|---|---|
| Ex. 1 | E > S | 32 | $6.1 \times 10^6$ | $1.1 \times 10^3$ | $3.6 \times 10^2$ | 50 |
| Ex. 2 | E > S | 32 | $6.1 \times 10^6$ | $2.2 \times 10^3$ | $3.2 \times 10^2$ | 50 |
| Ex. 3 | E > S | 47 | $1.7 \times 10^8$ | $1.4 \times 10^3$ | $1.0 \times 10^3$ | 100 |
| Ex. 4 | E > S | 32 | $6.1 \times 10^6$ | $1.1 \times 10^5$ | $1.3 \times 10^4$ | 150 |
| Ex. 5 | E > S | 47 | $1.7 \times 10^8$ | $7.6 \times 10^7$ | $2.8 \times 10^5$ | 150 |
| C.Ex 1 | E < S | 32 | $6.1 \times 10^6$ | $1.3 \times 10^8$ | $8.6 \times 10^8$ | 200< |
| C.Ex.2 | E > S | 47 | $1.7 \times 10^6$ | $1.1 \times 10^9$ | $6.0 \times 10^9$ | 200< |
| C.Ex.3 | E < S | 32 | $6.1 \times 10^8$ | $6.2 \times 10^8$ | $7.9 \times 10^8$ | 200< |
| C.Ex.4 | E > S | 30 | $2.6 \times 10^{10}$ | $4.5 \times 10^8$ | $3.3 \times 10^7$ | 200 |

Setting the surface layer resistance equal to or lens than $1.0\times10^8$ enables the photosensitive body-adhering toner quantity to be saturated with a development potential under 150 V.

Setting the thickness of the surface layer equal to or less than 30 $\mu$m prevents the paper from being rumpled without affecting tie hardness of the elastic layer or without being affected by the coefficient of contraction.

Since the adhering toner quantity on the photosensitive body comes to a saturation in a state in which the difference between the bias voltage and the surface potential of a portion of the latent image on the photosensitive body is equal to or less than 150 V, (1) though the development roll has a lower resistance, leak to the photosensitive body does not occur; (2) low-potential binary value development is achieved; and (3) since the electrostatic potential of the photosensitive body can be louvered, the lifetime of the photosensitive body can be lengthened.

In the above-described embodiments, the roll has been used for a development roll. However, the invention can be applied to various other fields, e.g., to a roll in a printing and so on.

It should be understood that the present invention is not limited to the specific embodiments as described in the specification, many different embodiments of the present invention may be made without departing from the scope of the present invention.

What is claimed is:

1. A roll, comprising:

a core shaft formed from metal;

an elastic layer, formed from resin or rubber material arranged around said core shaft, and having a resistance; and a surface layer, formed from resin material and a coating arranged around said elastic layer, and having a resistance, said resistance of said surface layer being smaller than said resistance of said elastic layer so that an entire volume resistance of said roll is less than a volume resistance of said elastic layer.

2. A roll according to claim 1, wherein said volume resistance of said elastic layer is less than $1.0\times10^9$ Ω·cm.

3. The roll of claim 2, wherein the entire volume resistance of said roll is less than $1\times10^7$ Ω·cm.

4. A roll according to claim 1, wherein the entire volume resistance of said roll is less than $1.0\times10^7$ Ω·cm.

5. A roll according to claim 4, wherein an actual resistance of said surface layer is less than $1.0\times10^8$ Ω.

6. A roll according to claim 1, wherein a thickness of said surface layer is less than 30 $\mu$m.

7. The roll according to claim 1, wherein a fluoro resin embrocation is provided on said elastic layer.

8. The roll according to claim 1, wherein said elastic layer comprises an urethane elastomer layer coating around said core shaft.

9. The roll according to claim 1, wherein a conductive urethane paint is provided on said elastic layer.

10. A development apparatus comprising the roll as recited in claim 1.

11. A development apparatus according to claim 10, wherein said apparatus comprises a photosensitive body having an image portions, and a quantity of toner adhering onto said photosensitive body is saturated under a condition that a difference between a development bias and a surface potential of said image portion in said photosensitive body is less than 150 V.

12. The development apparatus according to claim 10, wherein a fluoro resin embrocation is provided on said elastic layer.

13. The development apparatus according to claim 10, wherein a conductive urethane paint is provided on said elastic layer.

14. The development apparatus according to claim 10, wherein said elastic layer comprises a urethane elastomer layer coating around said core shaft.

* * * * *